United States Patent [19]

Neiger et al.

[11] Patent Number: 4,678,184

[45] Date of Patent: Jul. 7, 1987

[54] CONSTANT FORCE EXERCISE DEVICE

[75] Inventors: Henri J. C. Neiger, Melesse; Claude M. Genot, Mordelles; Gérard C. Prud'Hon, Boulogne; Michel Schoens, Villiers le Bel, all of France

[73] Assignee: Merobel - Societe Anonyme Fracaise, Paris, France

[21] Appl. No.: 692,658

[22] Filed: Jan. 17, 1985

[30] Foreign Application Priority Data

Jan. 20, 1984 [FR] France ..... 84 00925

[51] Int. Cl.[4] ..... A63B 21/24

[52] U.S. Cl. ..... 272/129; 272/132

[58] Field of Search ..... 272/129, 130, DIG. 6, 272/73, 128, 131–133, DIG. 4; 128/25 R

[56] References Cited

U.S. PATENT DOCUMENTS

| | | | |
|---|---|---|---|
| 3,366,903 | 1/1968 | Searle et al. | 335/209 |
| 3,465,592 | 9/1969 | Perrine | 272/130 |
| 3,572,700 | 3/1971 | Mastropaolo | 272/130 |
| 3,767,195 | 10/1973 | Dimick | 272/DIG. 6 |
| 3,869,121 | 3/1975 | Flavell | 272/129 |
| 3,966,201 | 6/1976 | Mester | 272/132 X |
| 3,989,240 | 11/1976 | Victor et al. | 272/129 X |
| 4,184,678 | 1/1980 | Flavell et al. | 272/129 |
| 4,244,021 | 1/1981 | Chiles, III | 272/DIG. 6 |
| 4,261,562 | 4/1981 | Flavell | 272/129 |
| 4,479,647 | 10/1984 | Smith | 272/129 X |
| 4,537,396 | 8/1985 | Hooper | 272/132 X |

*Primary Examiner*—Richard J. Apley
*Assistant Examiner*—Robert W. Bahr
*Attorney, Agent, or Firm*—Kane, Dalsimer, Kane, Sullivan and Kurucz

[57] ABSTRACT

The exercise apparatus includes a motor-reduction gear unit (10, 11) controlling an input shaft (20), and mounted on a frame (1). A drum (50) receives a cable (5) at the end of which there is placed a detector (155) and then a handle (56). Between the shaft (20) and the drum (50) there are mounted in parallel firstly a freewheel transmission (36) and, secondly an electromagnetic powder clutch (35). Various pre-adjusted control values for exciting the clutch (35) enable accurate adjustment of the apparatus, in particular for exercises of the "servo-controlled work", "static work", or "direct work" types, to be accompanied by "rest" phases.

13 Claims, 6 Drawing Figures

CONSTANT FORCE EXERCISE DEVICE

BACKGROUND OF THE INVENTION a. Field of the Invention

The invention relates to exercise apparatus intended, in particular, for re-educating, for training and for investigating the neuro-muscular function.

b. Description of the Prior Art

Devices are already known which tend to servo-control the resistance that they offer to the force produced by a patient. However, up to now, the various known devices have only been able to provide insufficient response to the needs encountered in sports training or in kinesitherapy, also known as physiotherapy.

SUMMARY OF THE INVENTION

The present invention provides improved exercise apparatus.

In known manner, the apparatus of the invention includes a fixed frame, a work member intended to be connected to a subject to be exercised, a motor member, a transmission device mounted between the work member and the motor member, and means for adjusting, monitoring and quantifying the force and/or the displacement of the work member as a function of determined parameters.

According to a general characteristic of the invention, said transmission device comprises, connected in parallel between the motor member and the work member, firstly a force coupler having an adjustable transmitted couple, and secondly a unidirectional drive means connecting the work member to the motor member when the ratio of their speeds in absolute value exceeds a predetermined threshold.

Other characteristics and advantages of the invention appear on examining the following detailed description and the accompanying drawings.

DETAILED DESCRIPTION OF THE INVENTION

Figure 1C:
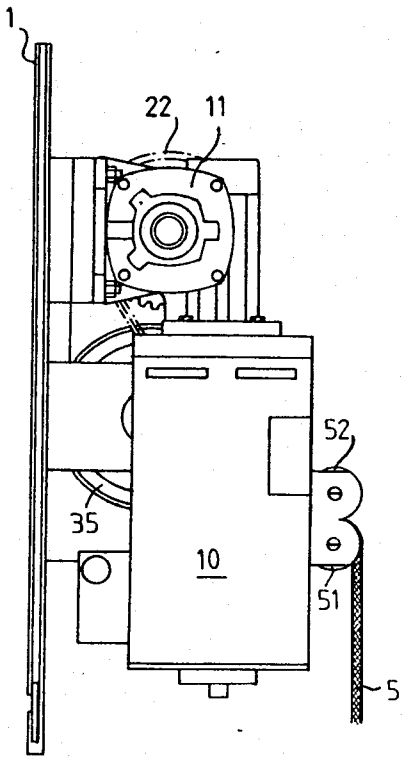
FIGS. 1A, 1B and 1C are respectively a front view, a left view and a right view of one embodiment of the mechanical portion of an apparatus in accordance with the invention without its cover.
Figure 1A:
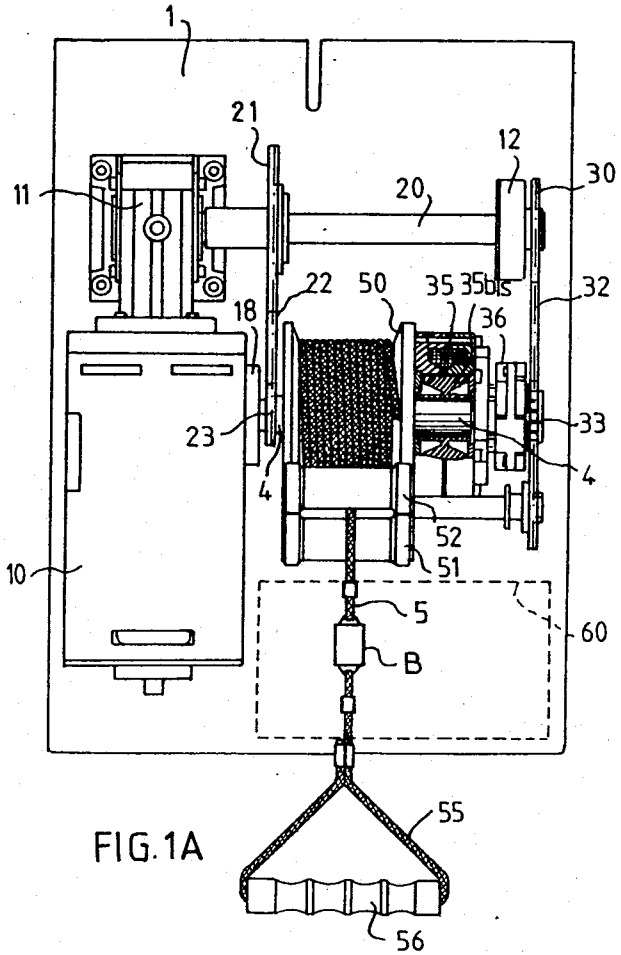
Figure 1B:
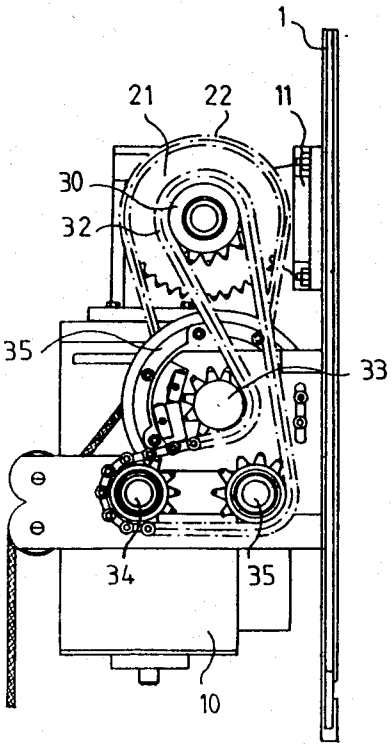

In FIGS. 1A to 1C, a frame 1 supports a motor 10 whose output shaft is connected to a non-reversible step-down gear 11.

The motor and the step-down gear may for example be a 400 watt model from Mely-Clerely operating at 0 to 3000 rpm.

The output shaft 20 from the gear 11 has its other end supported in a bearing 12. In between, it is fitted with toothed wheel of fairly large diameter 21. At its other end it is fitted with a second toothed wheel of smaller diameter 30.

Another bearing 18 which is fixed to the frame supports a shaft 4 on which there is a toothed wheel 23 of small diameter. The toothed wheel 23 is connected to the large toothed wheel 21 by a first transmission chain 22.

A rope-carrying drum 50 is rotatably mounted on the shaft 4.

The rope 5 leaves between two rope-guiding shafts 51 and 52 and its free end has a loop 55 formed therein holding, for example, a handle 56 (supposing that arm muscles are involved). Any other suitable grasping and/or fixing means may be used for other parts of the body, such as the legs.

The righthand end plate of the drum 50 is fixed to the outer ring of an electromagnetic powder clutch 35. This clutch may be a Merobel EAT 120 type clutch.

The inner ring 35bis of the clutch 35 is fixed to shaft 4.

The "excentric" movement chain constituted by the components 10, 11, 22, 23, 24 and 35bis, transmits is angular speed $N_2$ to the rope-carrying drum 50 when the inductor winding of the clutch 35 is powered. This chain thus tends to wind the rope onto the drum and to pull on the patient's arm via the handle 56. If the operator resists too strongly, the clutch "skids" and there is relative movement between the rings 35 and 35bis, but a rated force is still transmitted to the rope in the winding direction. The rated force depends on the adjustment of the excitation current passing through the inductor of the clutch 35.

The other clutch ring 35 is also connected to a ratchet or freewheel system 36, which is driven by a toothed wheel 33.

As can be seen more clearly in FIG. 1B, the toothed wheel 33 is driven in the opposite direction to the movement applied to the shaft 4 by the chain 22. This reverse drive is obtained by a second chain 32 which passes round the toothed wheel 30 as mentioned above, over two deflector wheels 34 and 35 and finally drives the ring 33 in the reverse direction.

$N_1$ denotes the speed of rotation of the shaft 20; $N_2$ denotes the speed applied by the belt 22 to the shaft 4 in a first direction; and $N_3$ denotes the lower speed which the belt 32 is capable of applying to the drum in the reverse direction, i.e. in the anti-clockwise direction. The clockwise direction corresponds to winding the rope 5 onto the drum 50, while the anticlockwise direction corresponds to winding the rope 5 off the drum 50.

It is now possible to define the general operation of the apparatus in accordance with the invention.

The ratchet 36 transmits no force to the outer ring 35 and to the drum 50 which is linked thereto until the action developed by the patient pulling on the rope by means of the handle 56 tends to cause it to rotate in the same direction as, and at a higher speed than, the rotation applied to the ratchet 36 by the "concentric" motion chain constituted by the components 10, 11, 20, 30, 32, 33, and 36.

If the patient tends to pull too fast, the ratchet 36 tends to drive the chain 33, 32, 30, 20 and cannot, in fact, drive this chain insofar as the step-down gear 11 is non-reversible. There is thus a "reaction" equal to the action applied by the patient; this reaction is servo-controlled to the force applied by the patient.

The maximum linear unwinding speed for the rope is preadjustable in a manner which is independent of the magnitude of the forces exerted, by means of a servo-control system operating on the motor and reduction gear unit 10 and 11, in a manner described below. The resistance provided by the rope to unwinding is thus directly servo-controlled to the active traction force applied by the patient.

In accordance with another aspect of the invention, it has been observed that while the rope is being unwound at a speed less than the programmed speed, the resistance to unwinding becomes practically zero. To remedy this, it is provided that the minimum force exerted by the subject should be controlled by programming a constant rewinding force $\delta$, by means of the electromagnetic clutch 35 and the chain drive 32. The patient must thus necessarily overcome the force $\delta$ in order to unwind the rope, even if this unwinding takes place at a speed which is less than the programmed nominal speed. The permanent force aded in this way is referred to as the rated force, and it opposes rope unwinding regardless of speed for speeds less than the preadjusted speed at which the servo-controlled reaction begins.

With reference to the conventional terminology in kinesitherapy and physiotherapy, this function may be called "servo-controlled concentric dynamic" mode muscle training.

The apparatus in accordance with the invention may also develop static muscular contractions and excentric dynamic contractions obtained by the above-mentioned excentric chain. As explained below, these three modes of exercise may be sequenced in a predetermined manner.

Both the excentric drive chain 10, 11, 21, 22, 23, 4, 35bis and the servo-controlled concentric drive chain 10, 11, 20, 30, 32, 33, and 36 make use of a common motor 10, 11.

In practice, it may be advantageous to provide two independent motor and reduction gear units, one for each drive chain.

In this case, the shaft 20 is split in two, and its right-hand portion is connected to a second motor and step-down gear unit (not shown). It is then possible to obtain improved performance by virtue of the speeds and the powers of the two drive chains being independent.

Figure 2:
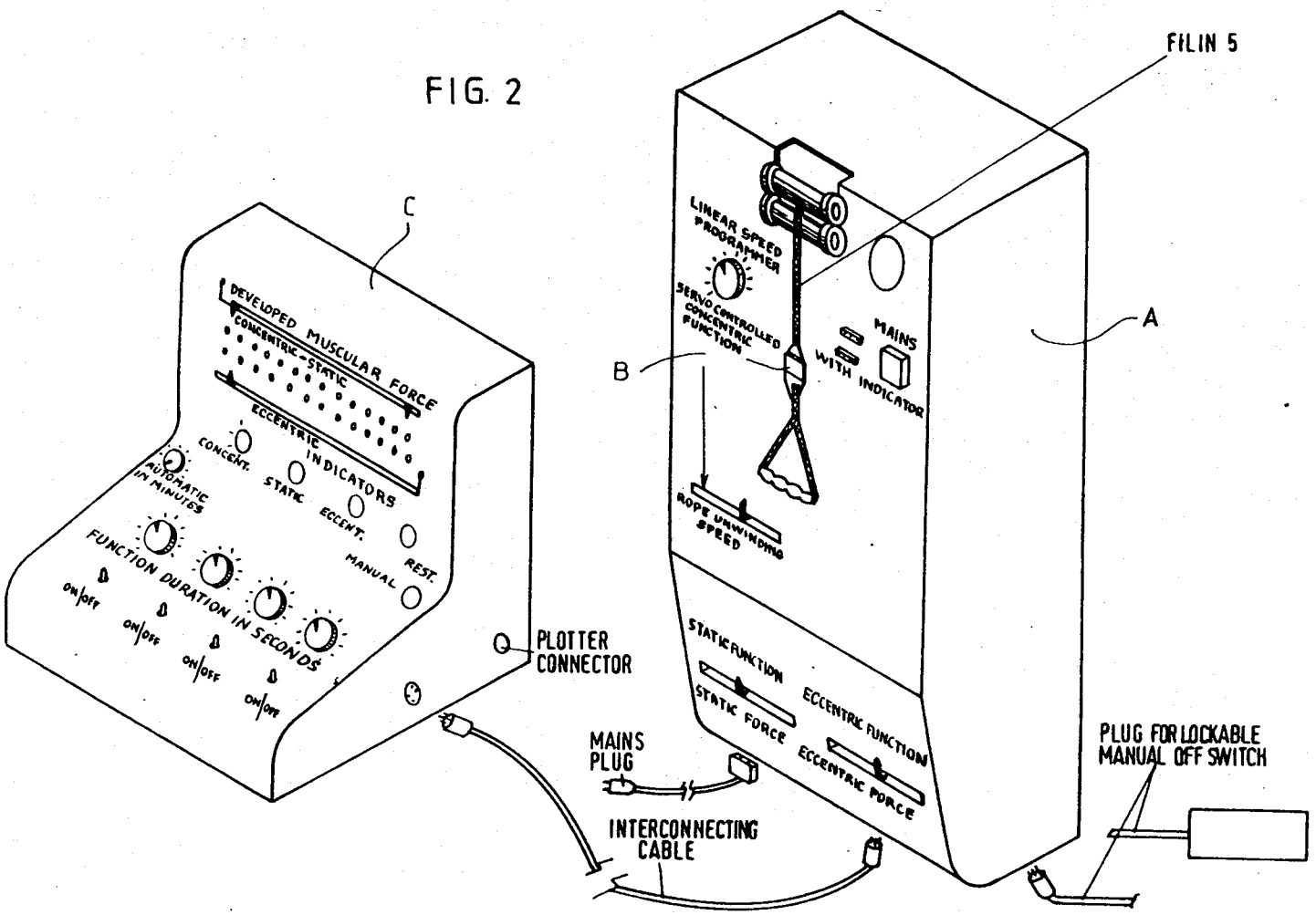
FIG. 2 is a diagram of the general appearance of a preferred embodiment of apparatus in accordance with the invention.
Figure 3A:
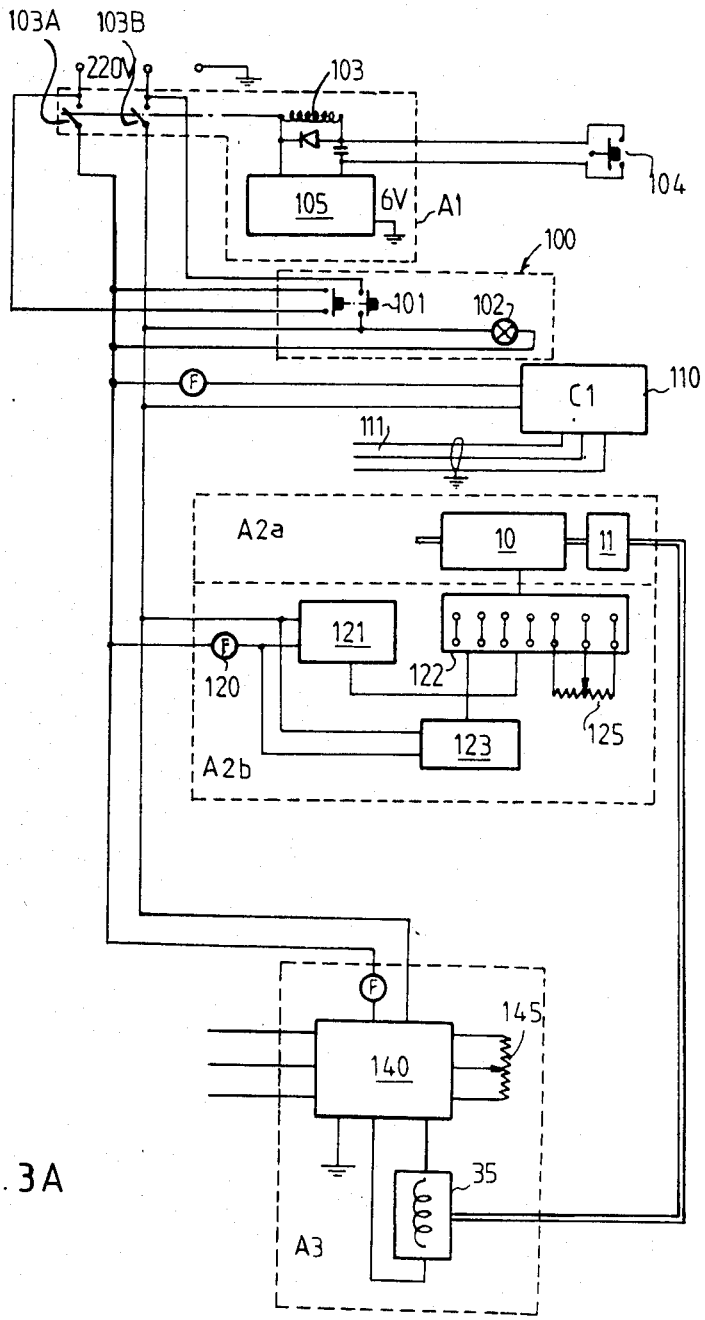
FIG. 3 is a diagram of the electronic portion of the apparatus in the same preferred embodiment.

FIG. 2 is a diagram showing the main blocks constituting apparatus in accordance with the present patent:

(1) The fixed frame plus adjustable speed motor plus reduction gear assembly together with the transmission device and a portion of the control electronics described below with reference to FIG. 3 are enclosed in a block A which is the main item for generating action and reaction and which is intended to be rigidly connected to a fixed base or to a pulley-therapy cage. The block A includes the main adjustments of the operating conditions for defining the functions to be performed and which are preferably under the control of monitoring personnel. The block A is generally placed at some distance from the patent.

(2) A block B is linked in the application described firstly to the block A by a rope and secondly to a handle which is itself grasped by the operating patient.

It includes force and/or position detector device(s) together with a transmitter for wire-less transmission of the signals from said detector(s) to a receiver/decoder situated in a block C.

(3) The block C is a movable unit placed within the reach of the subject being trained and of the specialized personnel monitoring and programming the exercises of one or more subjects.

It comprises: devices for programming the training cycle; display functions for the cycle operations and for the magnitudes of the forces or the positions effectively developed or attained; systems for signalling and counting failures or successes; items for generating output signals for recording purposes (for example on an xy or an x(t) plotter); items for programming the duration of the functions in the chosen cycle; and systems for manual or automatic operation which are programmable as a function of time and/or as a function of the length of rope which is delivered or rewound.

A fixed link via an interconnecting cable is established between the blocks A and C to convey electrical power and adjusting signals.

A detailed description of the controlling sub-blocks or electrical adjustment sub-blocks or electronic sub-blocks for controlling operation is now given with reference to FIG. 3.

Figure 3B:
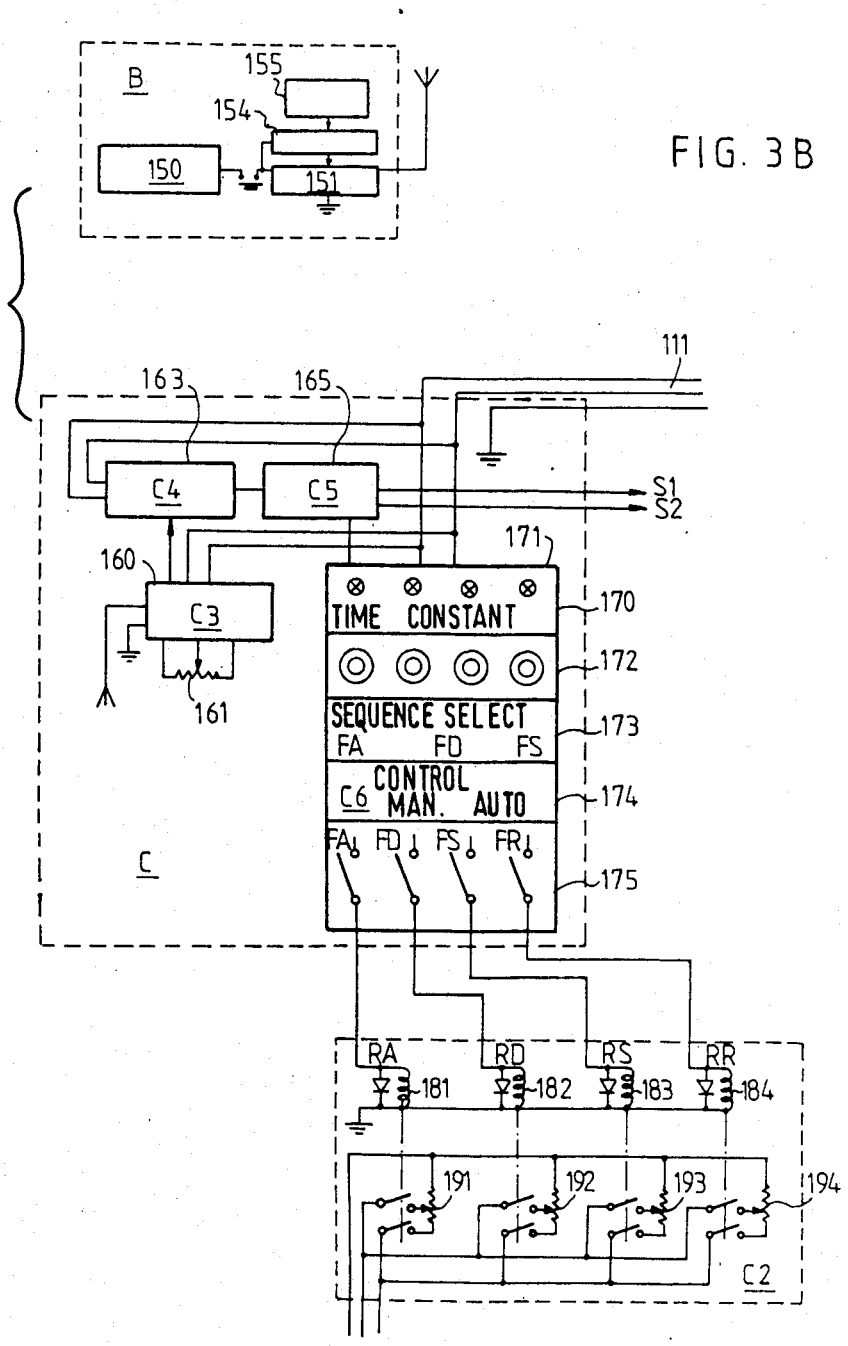

Reference is now made to FIG. 3 (and/or FIG. 3bis) which show a certain number of sub-blocks of an electric circuit diagram.

The sub-blocks A are intended to constitute a portion of the fixed wall-mounted frame of FIG. 2 which constitutes the work unit A. The block B is a sensor circuit which is physically situated between the work unit A and the handle 56, as may be held by the patient, for example.

The sub-blocks C form a part of the movable unit made available to the subjects under training, and also to the specialized personnel directing the exercises of one or more patients.

The block A includes the mechanical components illustrated in FIGS. 1A, 1B and 1C. An electronic circuit constituted by five distinct cards is mounted on the frame or on an intermediate shelf (given that the assembly is fixed to the wall).

The card A1 defines the general power supply circuit for connection to mains. It is constituted by a main on/off pushbutton having two states, and capable of interrupting both the live and the neutral wires. The pushbutton is marked 101 and an associated indicator lamp is marked 102. Downstream from this switch there is a highly isolated low voltage safety power supply 105. This power supply supplies the various currents required by the electronic circuits, and in particular at six volts. It also powers, by means of auto-excitation, a relay 103 suitable for switching off the general power supply by means of moving contacts 103A and 103B. The electric circuit for controlling the relay 103 passes through a single state manual push button switch 104 which is made available to patients in difficulty so that they can turn off the apparatus at any moment. In addition, an automatic detector such as a current sensitive relay (not shown) may be inserted in the inlet to the 220 volt, 50 Hertz circuit.

A block 110 for powering the movable unit C is connected to the 220 volt AC power supply downstream from the above-described safety means, and constitutes a first module C1 thereof. A set of ground or earth linking wires thus passes to the movable unit C from the housing 110.

The motor 10 and its step-down gear 11 can be seen again on a card A2*a*. The general AC power supply is fed via a fuse 120 to variator means 121 which are connected to the terminals of a control and servo-control circuit 122 for the motor 10. The motor is excited from a block 123 in a manner known per se. Finally, the block 122 includes a potentiometer unit 125 which defines the maximum speed of the motor as a function of the exercise to be performed by the patient.

For the above-mentioned motors and gear units, the blocks 121, 122 and 123 may be made up as follows:

121 an electronic variator type 433 from Mely-Clerely;

122 a relay block with the wire-wound potentiometer; and 123 a Mely-Clerely CC power supply for motor excitation.

The potentiometer 125 has a value of 10 kilohms.

Returning to the unit C, the work unit includes a relay card C2. Its constitution is described in detail below. For the moment it is sufficient to know that the card C2 provides four wires indicating currents representative of minimum rewinding forces or couples. This information is applied to a current generator 140 which is powered by the general power supply and which controls the powder clutch 35.

For the above-mentioned powder clutch, which is an EAT 120 model, the current generator is a Merobel type 1 model. A potentiometer 145 serves to define the mininum rope re-winding couple.

Reference is now made to the block B. This is a self-contained unit having a battery 150 which powers a transmitter circuit 151 operating at 27.2 MHz, for example. A sensor 155, which may be of the strain gauge type for example, is fixed on a deformable metal plate. This plate may be incorporated in the wire-guiding rolls 51 and 52 if these rolls are subjected to the major part of the force conveyed by the rope. In a variant, the plate may be directly incorporated in the rope itself, adjacent to its end 55. Changes in electrical resistance set up by mechanical deformation of the plate or the strain gauge controls a voltage applied to a modulator 154 for the transmitter 151.

Naturally, a multichannel transmitter could be provided when a plurality of parameters are to be monitored simultaneously and/or sequentially.

The movable unit C constitutes a self-contained control and monitoring desk enabling a qualified operator to control the functions or exercises which the patient will perform or to which the patient will be subjected, with the operator being informed by the movable unit on the effectiveness of the exercises and the extent to which they correspond to the programmed activity.

A receiver 160 tuned to the same frequency as the transmitter 151 receives the signal therefrom. The receiver 160 is provided with an output level adjustment by means of a potentiometer 161. It is powered, as are all the other components in the housing C, by the above-mentioned power supply 110. The signal supplied by the receiver 160 is applied to a force display circuit marked 163. This display circuit may comprise several types of display means, and in particular a row of light-emitting diodes (LEDs) producing a line of bright points whose length varies with the amplitude of the developed force. In a variant, a galvanometer may be used.

The output from the housing 163 may be connected to an adapted 165 intended to be connected in turn to a recorder by means of output lines S1 and S2. The recorder is not shown.

The most important member of the unit C is an assembly 170. This comprises a series of at least four bistable flip-flops having respective timings of 0 to 20 seconds provided by a delay circuit, e.g. an RC type circuit, for establishing a pre-established timed sequence of events. In normal automatic operation each bistable triggers the following bistable at the end of its period, thus automatically producing a repetitive exercise. For example, the cycle could be:

servo-controlled function (also called concentric);
static function;
direction function (also called excentric); and
rest.

This sequence of events which is programmed as a function of time may be replaced by a sequence programmed as a function of the length of rope paid out (or the length of rope wound back in).

For example, the passage of magnetic inserts incorporated in the rope and passing in front of a detector disposed inside or outside the apparatus (shafts 51 and 52) could be detected in order to trigger switching to the next item in the sequence. It would also be possible to detect the number of turns made by the drum from a zero position by means of an encoder or a multi-turn potentiometer driven by the drum 50 (together with any gear ratio that may be appropriate). After a chosen number of turns, the voltage available at the terminals of the encoder or of the potentiometer controls a relay to switch the functions over to the following exercise.

171 indicates LEDs for marking the current function. 172 indicates adjustment potentiometers forming a part of the above-mentioned RC circuits and serving to adjust the period for which each bistable is activated, e.g. from 0 to 20 seconds.

At 174, there are provided:

firstly a "manual operation" pushbutton for activating the cycle that has been set up; and secondly a timer having an "on" contact for activating the cycle as set up for a chosen duration, said timer having a maximum capacity of 30 minutes for example. At the end of the pre-adjusted period, the timer opens the contacts of the push buttons shown at 173 thus either short-circuiting or storing the various functions provided, namely the servo-controlled function, the direct function, the static function, and the rest function. This function selection is simply performed by short-circuiting the corresponding bistable(s) on each occasion at the period related to the unwanted function.

Finally, at the bottom of the device 170 within the box 175 there are four contacts or "states" of which only one is activated at a time during the cycle and which define the current function as selected from the four above-mentioned functions (servo-controlled, static, direct, rest).

We return to the housing C2. The four contacts or states are transmitted over electrical connections 179 leading to four relay windings 181 to 184 respectively associated therewith. Each of these relay windings enables contacts enabling a corresponding potentiometer 191 to 194 to be used such that the potentiometer selected is connected to the three terminals of the current generator 140.

It can immediately be seen that it is thus possible to define the action mode of the clutch for each of the four functions described. In other words, the return force of the clutch 35 is precisely defined for the selected type of work by each of the potentiometers 191 to 194.

Applications, in particular in kinesitherapy-physiotherapy concern restoring, improving and investigating neuro-muscular functions. The apparatus (A) may optionally be used in a pulley-therapy cage. The rope 5 may be used either analytically or functionally, which use associates the mobility of various body segments in several planes. The programmable rope paying out speed serves to execute activities at various reproducible speeds depending on the desired objective. Servo-controlling the resistance to the developed traction force serves to ensure that subjects always train to the maximum of their capabilities independently of the position adopted for a given speed. Further, this servo-control cancels the painful sector which sometimes appears when lifting direct loads. Since the apparatus is programmable, it can be used to provide specific training for subjects using cycles which associate different muscular contractions: concentric, servo-controlled, static and/or excentric.

By detecting the force that is developed and displaying it at the display system, it is possible to provide a biofeedback technique which is useful to subjects for monitoring their activities. Further, because this apparatus enables the rope winding-in forces to be programmed and the sequences to be switched, it may be used for joint tractions and for osteoarticulation postures.

We claim:

1. An apparatus for training, investigating and reeducating neuro-muscular functions in a subject, the apparatus comprising:

a frame fixed on a support;

a work member, supported by said frame, for interfacing with a subject to be exercised;

a non-drivable motor means rotable in a motor direction first and second mechanical transmission means arranged in parallel between the motor means and the work member;

said first mechanical transmission means being provided for driving said work member in a first direction of motion, depending upon the motor direction, and comprising a controllable force coupler;

said second mechanical transmission means being provided to drive said work member in a second direction of motion opposed to said first direction of motion, and comprising a unidirectional drive means for rendering said second mechanical transmission means operative when an absolute value of the ratio between the work member speed and the motor means speed exceeds a preselected threshold; and means for controlling said motor means and said controllable force coupler as a function of predetermined parameters.

2. The apparatus according to claim 1, wherein:

said motor means comprise at least one electric motor, which is speed servo-controlled, and coupled to a non reversible step-down gear;

said work member comprises a rotary drum on which a cable is wound, said cable having a cable end provided with grasping means for grasping by said subject; and said force coupler comprises a clutch.

3. The apparatus according to claim 2 wherein the clutch (35) is a electromagnetic power clutch.

4. The apparatus according to any one of claims 2 or 3, wherein the unidirectional drive means consists in a freewheel device (36) interposed between the inlet shaft and the drum.

5. The apparatus according to claim 1, further comprising one or more electronic detectors for transmitting the positions (155) and the forces associated with the work member, or with the grasping means.

6. The apparatus according to claim 5, further comprising, display means (163) for displaying data derived from said detector.

7. The apparatus according to claim 1, further comprising pre-adjustable clock means (170) for displaying one or more successive operational periods.

8. The apparatus according to claim 7, further comprising a control means enabling exercise functions to be performed in a predetermined order.

9. The apparatus according to claim 1, further comprising a wall module (A) intended for the subject and including the mechanical portion and the associated controls, a detection module (B), and a movable monitoring and control module (C) for use by an operator and by the subject.

10. The apparatus according to claim 1, further comprising manual control means for complete turn-off (104) intended for the subject.

11. The apparatus according to claim 1, further comprising a VHF or FM transmitter/receiver system capable of transmitting data concerning forces and positions of the movable control module C.

12. The apparatus according to claim 1, further comprising one or more electronic detectors for transmitting the positions (155) or the forces associated with the work member, or with the grasping means.

13. The apparatus according to claim 1, further comprising a VHF or FM transmitter/receiver system capable of transmitting data concerning forces or positions of the movable control module C.

* * * * *